United States Patent [19]

Thomason et al.

[11] 4,201,265

[45] May 6, 1980

[54] SIDEPOCKET MANDREL AND METHOD OF MAKING

[75] Inventors: James M. Thomason; Francis D. Logan, both of Houston, Tex.

[73] Assignee: Camco, Incorporated, Houston, Tex.

[21] Appl. No.: 2,528

[22] Filed: Jan. 11, 1979

[51] Int. Cl.[2] ..... E21B 7/06

[52] U.S. Cl. ..... 166/117.5; 29/522 R

[58] Field of Search ..... 166/117.5; 29/522 R

[56] References Cited

U.S. PATENT DOCUMENTS

| | | | |
|---|---|---|---|
| 3,603,393 | 9/1971 | Terral et al. | 166/117.5 |
| 3,741,299 | 6/1973 | Terral | 166/117.5 |
| 3,802,503 | 4/1974 | McGinn | 166/117.5 |
| 4,106,563 | 8/1978 | Gatlin et al. | 166/117.5 |

*Primary Examiner*—James A. Leppink

*Attorney, Agent, or Firm*—Fulbright & Jaworski

[57] ABSTRACT

In a sidepocket mandrel for use in a well tubing in which the valve pocket is positioned inside of the mandrel body beside an opening with a deflector guide connected to the pocket and having a pair of rails for allowing the entrance of flow control devices into the pocket but preventing the entrance of open bore tools into the guide path and a locking lug secured to the deflector guide, the improvement of providing the longitudinal outer edges of each of the rails adjacent the open bore with a deformable lip protruding outwardly from the rail in which the lips are bent outwardly towards and against the inside of the body for preventing wirelines of well tools from catching between the inside of the body and the rails. The lips may be formed in the rails by either longitudinal recesses positioned along the edges on either the inside or outside of the rails. The lips may be bent outwardly by expanding a tool between one portion of the outer edges of each of the rails after the rails have been positioned in the body and longitudinally moving the expanded tool to bend other portions of the edges outwardly.

6 Claims, 5 Drawing Figures

SIDEPOCKET MANDREL AND METHOD OF MAKING

BACKGROUND OF THE INVENTION

Generally, it is old to provide a sidepocket mandrel for use in a well tubing which has an orienting sleeve for aligning a kickover tool for inserting or removing flow control devices from the sidepocket of the mandrel in which a deflector guide is positioned in the mandrel above the pocket and in which the pocket and guide are positioned internally of the mandrel body as best seen in U.S. Pat. No. 4,106,563. It is desirable that the guide rails of the deflector guide be positioned, as shown in FIG. 2 of that patent, in mating coaction with the inside walls of the body. However, the desired flush fitting of the side rails against the inside of the mandrel body is frequently not obtained and gaps occur between the sides of the rails and the mandrel body into which a wireline on which well tools are moved through the well bore may catch. Obviously, this is undesirable and defeats one of the purposes of the deflector guide which is to prevent objects from becoming caught in sidepocket mandrels. The present invention is directed to an improved sidepocket mandrel and method of manufacture which reduces the problems found in the prior art devices.

SUMMARY

The present invention is directed to an improved sidepocket mandrel of the type having a deflector guide positioned in the offset bore above the sidepocket and having a pair of rails forming a guide path for guiding a flow control device into the pocket and deflecting open bore tools from the offset bore in which the longitudinal outer edges of each of the rails adjacent the open bore include a deformable lip protruding outwardly from the rail. The lips are bent outwardly towards and preferably against the inside of the body for preventing the wireline of well tools catching between the inside of the body and the rails.

Still a further object of the present invention is the provision of providing lips on the guide rails by either a longitudinal recess positioned on the outside of each of the rails or on the inside of each of the rails adjacent the outer edges which may be formed in any suitable manner such as by cutting or casting.

A still further object is the provision of a method of manufacturing a sidepocket mandrel in which a deflector guide having a pair of rails forming a guide path therebetween is welded to the valve pocket, a locking lug is secured to the guide rails, the pocket is then positioned inside the body of a mandrel in the offset bore adjacent a body opening and welded in place, the rails are welded in place to the body and the longitudinal edges of each of the rails are bent towards the inside of the body for closing any gap inside of the body and the rails. The method further comprehends performing the bending operation by expanding a tool between one portion of the outer edges of each of the rails and longitudinally moving the expanding tool to bend other portions of the rail edges outwardly.

Other and further objects, features and advantages will be apparent from the following description of presently preferred embodiments of the invention, given for the purpose of disclosure and taken in conjunction with the accompanying drawings.

DESCRIPTION OF THE PREFERRED EMBODIMENT

Figure 1:
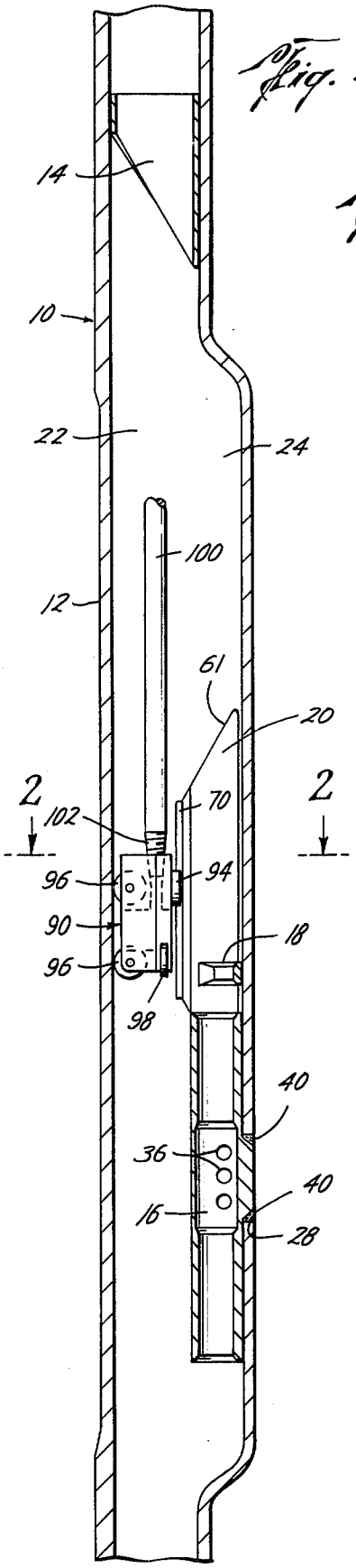
FIG. 1 is a fragmentary elevational view, in cross section, of the mandrel of the present invention prior to the deformable lips being bent outwardly towards the inside of the mandrel body.

Referring now to the drawings, and particularly to FIG. 1, the reference numeral 10 generally indicates the improved mandrel of the present invention which generally includes a body 12, an orienting sleeve 14, a sidepocket 16, a locking shoulder 18 and a deflector guide 20. The body 12 includes an open bore 22 extending therethrough for alignment with a well tubing into which the mandrel is inserted by threaded connections (not shown) at each end and an offset bore 24. The body further includes an opening 28 in communication with the offset bore 24 and the sidepocket 16.

Figure 2:
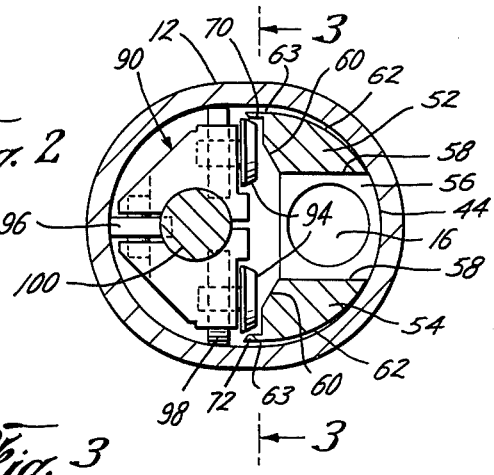
FIG. 2 is an enlarged cross-sectional view taken along the line 2—2 of FIG. 1.

Now referring to FIGS. 1 and 2, the deflector guide 20 is best seen for protecting flow control devices seated in the pocket 16 from damage by open bore well tools moving through the open bore 22, for preventing open bore tools from catching on flow control devices, and for guiding an oriented flow control device towards the sidepocket 16. The deflector guide 20 is positioned in the offset bore 24 and its axis is aligned with the axis of the offset pocket 16. And as best seen in FIG. 1, the top 61 of the deflector guide 20 extends upwardly and outwardly from the open bore 22 for providing a deflecting surface which deflects open bore tools.

The deflector guide 20 includes a pair of rails 52 and 54 forming a guide path 56 therebetween. The guide path is aligned over the sidepocket 16 and is sized to receive any flow control device to be seated in the pocket 16 but prevents the entrance of open bore tools into the guide path 56. Preferably, the rails 52 and 54 include longitudinal sides 58 on either side of the guide path 56 and deflecting sides 60 which are transversely directed toward the guide path 56 for guiding well flow control devices into the guide path 56. In addition, the rails 52 and 54 include sides 62 which ideally are shaped to conform to the inside of the mandrel body 12 in the offset portion 24. However, as seen in FIG. 2, because of manufacturing tolerances, gaps 63 may occur between the sides 62 of the rails 52 and 54 and the inside wall of the body 12. The gaps 63 are undesirable and detract from one purpose of the deflector guide 20 of deflecting as the gaps 63 provide a crevice into which objects and particularly the wirelines which actuate well tools may become caught.

Referring still to FIG. 1, the pocket 16 is positioned in the bore 24 adjacent the body opening 28 and includes a plurality of ports 36 for admitting or expelling fluids between the interior and exterior of the mandrel 10 as is conventional. The pocket 16 is positioned inside of the mandrel body 12 and is secured in place adjacent the opening 28 by suitable welds 40 around the periphery of the opening 28. The sidepocket 16 includes one side 44 which is shaped to conform to the inside of the body 12.

While of course the guide 20 and sidepocket 16 may be made integrally, it is preferred that they be made separately and joined, such as welding, prior to insertion in the body 12 of the mandrel and are thereafter secured on the inside of the mandrel body by the welds 40 to the pocket 16 and by welding the rails 52 and 54 to the body 12. The locking lug 18 may be secured in any desired manner to the rails 52 and 54 such as by insertion into a keyway or by welding.

As has been indicated in manufacturing the mandrel 12, the deflector guide 20, the locking lug 18 and the pocket 16 are connected together exteriorly of the body 12 and are inserted in place with the pocket 16 adjacent the opening 28 and welded by the welds 40. Thereafter the guide deflector 20 is welded in the body 12. And, as has been indicated, it is highly desirable that the rails 52 and 54 fit tightly up against the inside walls of the body 12 and eliminate the gaps 63 shown in FIG. 2. However, because of manufacturing procedures and tolerances, the gaps 63 do exist frequently and the present invention is directed to eliminating or reducing the gaps 63 so as to prevent objects such as wirelines from catching in the mandrel 10.

Figure 4:
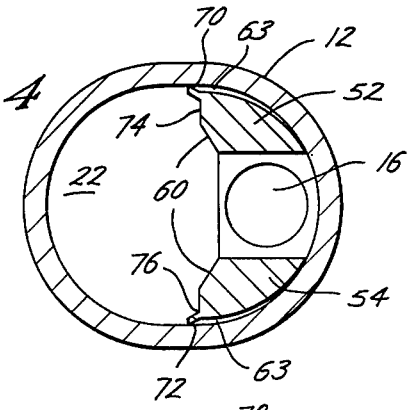
FIG. 4 is a cross-sectional view of the mandrel of FIGS. 1 and 2 after the deformable lips have been bent outwardly against the inside of the body.
Figure 5:
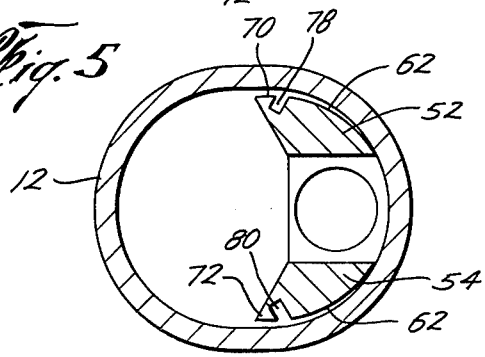
FIG. 5 is another embodiment of the present invention prior to bending the outer longitudinal edges of the rails outwardly.

As best seen in FIGS. 1 and 2, the present invention is directed to providing a deformable lip 70 and 72 over the longitudinal outer edges of each of the rails 52 and 54, respectively, which protrude outwardly from the rails as best seen in FIG. 2. After the rails 52 and 54 have been secured in place in the body 12, the lips 70 and 72 bent outwardly, as best seen in FIG. 4 towards the inside of the body 12 thereby blocking the gaps 63 and preventing wirelines from catching in the gaps 63 between the rails 52 and 54 and the inside of the body 12. The deformable lips 70 and 72 may be formed in any desired manner such as casting or forging integrally with the rails 52 and 54 or by cutting a longitudinal recess 74 and 76 out of the front side 60 of the rails 52 and 54, respectively. And as shown in FIG. 5, a recess 78 and 80 may be cut from the outsides 62 of the rails 52 and 54, respectively. In the embodiment of FIG. 5, the lips 70 and 72 would then be bent outwardly and preferably against the inside of the body 12.

Figure 3:
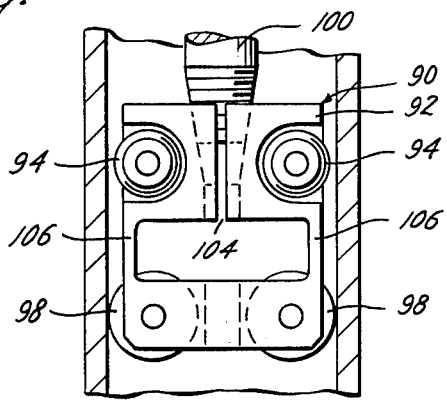
FIG. 3 is a cross-sectional view taken along the line 3—3 of FIG. 2.

Referring now to FIGS. 1, 2 and 3, one form of an apparatus for bending the lips 70 and 72 outwardly against the inside of the body 12 is shown. While the bending apparatus, generally indicated by the reference numeral 90, is a mechanical apparatus, suitable pneumatic or hydraulic apparatus can be provided. The bending apparatus 90 includes a body 92 carrying a pair of beveled bending wheels 94 for pressing lips 70 and 72 outwardly, one or more top guide wheels 96, and one or more side guide wheels 98, and an actuating shaft 100. The shaft 100 includes a wedge screw 102 threaded in the body 92 for wedging in the body 92 for forcing the beveled wheels 94 outwardly. The body 92 includes a slot 104 and thin sections 106 for readily allowing the beveled wheels 94 to be wedges outwardly by rotation of the shaft 100. In addition, the shaft 100 extends out of the open bore of the mandrel 10 whereby longitudinal movement of the shaft 100 will longitudinally move the body 92 and wedging wheels 94 along the longitudinal lips 70 and 72 thereby bending the lips 70 and 72 outwardly against the inside of the mandrel body 12. The various guide wheels 96 and 98 assure the positioning of the beveled wheels 94 securely against the lips 70 and 72.

In use, flow control devices may be conveniently installed and removed from the offset pockets 16 by suitable kickover tools similar to that described in U.S. Pat. No. 3,741,299.

The present invention, therefore, is well adapted to carry out the objects and attain the ends and advantages mentioned as well as others inherent therein. While presently preferred embodiments of the invention are given for the purpose of disclosure, numerous changes in the details of construction and arrangement of parts, may be made which will readily suggest themselves to those skilled in the art and which are encompassed by the spirit of the invention and the scope of the appended claims.

What is claimed is:

1. In a sidepocket mandrel for use in a well tubing having a hollow body having an inside with an open bore extending therethrough and an offset bore, said body having an opening in communication with the offset bore, a valve pocket positioned inside the body and beside the body opening for receiving flow control devices, a deflector guide positioned in the offset bore above and connected to the pocket and having a pair of rails having longitudinal outer edges with a gap between the outer edges and the inside of the body and forming a guide path therebetween for allowing the entrance of flow control devices into said pocket but preventing the entrance of open bore tools into the guide path, a locking lug secured to the deflector guide, and an orienting sleeve positioned in the open bore, the improvement comprising, the longitudinal outer edges of each of said rails adjacent the open bore having a deformable lip protruding outwardly from said rail, said lips being bent outwardly towards the inside of the body for closing the gaps between the inside of the body and said rails.

2. The apparatus of claim 1 wherein said lips are formed in the rails by a longitudinal recess positioned on the side of each of said rails adjacent the inside of the body and adjacent said outer edges.

3. The apparatus of claim 1 wherein said lips are formed in the rails by a longitudinal recess positioned on the sides of the rails adjacent the open bore and adjacent said longitudinal outer edges.

4. In the method of manufacturing a sidepocket mandrel having a body having an inside with an open bore therethrough and an offset bore in which a deflector guide having a pair of rails having longitudinal outer edges and forming a guide path therebetween is welded to a valve pocket, a locking lug is secured to the guide rails, the pocket is then positioned inside the body of a mandrel in the offset bore adjacent a body opening and welded in place, and the rails are welded in place to the body, the improvement comprising, bending the outer longitudinal edges of each of the rails towards the inside of the body for preventing objects from catching between the inside of the body and said rails.

5. The method of claim 4 wherein the bending is performed by expanding a tool between one portion of the longitudinal outer edges of each of the rails and longitudinally moving the expanded tool to bend other portions of the longitudinal outer edges outwardly.

6. The method of claim 5 including the step of forming a longitudinal deformable lip protruding outwardly from each of the rails along the outer longitudinal edges.

* * * * *